US009729993B2

(12) United States Patent
Vilermo et al.

(10) Patent No.: US 9,729,993 B2
(45) Date of Patent: Aug. 8, 2017

(54) APPARATUS AND METHOD FOR REPRODUCING RECORDED AUDIO WITH CORRECT SPATIAL DIRECTIONALITY

(71) Applicant: Nokia Technologies Oy, Espoo (FI)

(72) Inventors: Miikka Tapani Vilermo, Siuro (FI); Juha Henrik Arrasvuori, Tampere (FI); Kari Juhani Jarvinen, Tampere (FI); Roope Olavi Jarvinen, Lempäälä (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/432,145

(22) PCT Filed: Oct. 1, 2012

(86) PCT No.: PCT/IB2012/055257
§ 371 (c)(1),
(2) Date: Mar. 27, 2015

(87) PCT Pub. No.: WO2014/053875
PCT Pub. Date: Apr. 10, 2014

(65) Prior Publication Data

US 2015/0245158 A1 Aug. 27, 2015

(51) Int. Cl.
*H04S 7/00* (2006.01)
*H04R 5/02* (2006.01)

(52) U.S. Cl.
CPC ..... *H04S 7/302* (2013.01); *H04R 5/02* (2013.01); *H04S 2400/11* (2013.01);
(Continued)

(58) Field of Classification Search
CPC ..... H04R 5/02; H04S 7/302; H04S 2400/15
See application file for complete search history.

(56) References Cited

U.S. PATENT DOCUMENTS

2008/0170705 A1 7/2008 Takita
2011/0013790 A1* 1/2011 Hilpert ..... G10L 19/008 381/300

(Continued)

FOREIGN PATENT DOCUMENTS

EP 2 323 425 A1 5/2011
WO WO-2008/046530 A2 4/2008

(Continued)

OTHER PUBLICATIONS

International Search Report and Written Opinion received for corresponding Patent Cooperation Treaty Application No. PCT/IB2012/055257, dated Aug. 29, 2013, 12 pages.

*Primary Examiner* — Brenda Bernardi
(74) *Attorney, Agent, or Firm* — Harrington & Smith

(57) ABSTRACT

An apparatus comprising: an input configured to receive from at least one co-operating apparatus at least one audio signal; an audio signal analyzer configured to analyze the at least one audio signal to determine at least one audio component position relative to the at least one co-operating apparatus recording position; and a processor configured to determine an position value based on the at least one cooperating recording position and the apparatus position, and further configured to apply the position value to the at least one audio component position, such that the at least one audio component position is substantially aligned with the apparatus position.

20 Claims, 8 Drawing Sheets

(52) U.S. Cl.
CPC ..... *H04S 2400/15* (2013.01); *H04S 2420/03* (2013.01); *H04S 2420/07* (2013.01)

(56) References Cited

U.S. PATENT DOCUMENTS

2011/0164769 A1* 7/2011 Zhan ..... G10L 19/008 381/307
2011/0249819 A1* 10/2011 Davis ..... H04S 5/005 381/17
2011/0301730 A1 12/2011 Kemp et al.
2013/0147923 A1* 6/2013 Zhou ..... H04B 3/20 348/47

FOREIGN PATENT DOCUMENTS

WO 2008113427 9/2008
WO WO-2010/080451 A1 7/2010

* cited by examiner

APPARATUS AND METHOD FOR REPRODUCING RECORDED AUDIO WITH CORRECT SPATIAL DIRECTIONALITY

RELATED APPLICATION

This application was originally filed as PCT Application No. PCT/IB2012/055257 filed Oct. 1, 2012.

FIELD

The present application relates to apparatus for spatial audio signal processing. The invention further relates to, but is not limited to, apparatus for spatial audio signal processing within mobile devices.

BACKGROUND

Spatial audio signals are being used in greater frequency to produce a more immersive audio experience. A stereo or multi-channel recording can be passed from the recording or capture apparatus to a listening apparatus and replayed using a suitable multi-channel output such as a pair of headphones, headset, multi-channel loudspeaker arrangement etc.

Furthermore networked or connected apparatus and device configurations allow multiple apparatus to capture audio and video data in such a way that there is a large degree of similarity between the audio and visual captured elements between devices. For example live events can be recorded or captured from different angles by many users. In order to capture aspects of the scene and also present good quality audio and video signals representing the scene it can be necessary to use video and audio from different apparatus. In other words the best quality audio and video for a specific captured incident or scene is not always produced by the same device. For example audio quality can be significantly degraded with distance from the event whereas optimal video quality can depend more on the video angle of the viewer, camera shake, and other factors which can lead to the camera being located further from the event or scene.

SUMMARY

Aspects of this application thus provide a spatial audio capture and processing whereby listening orientation or video and audio capture orientation differences can be compensated for.

According to a first aspect there is provided an apparatus comprising at least one processor and at least one memory including computer code for one or more programs, the at least one memory and the computer code configured to with the at least one processor cause the apparatus to at least: receive from at least one co-operating apparatus at least one audio signal; analyse the at least one audio signal to determine at least one audio component position relative to the at least one co-operating apparatus recording position; determine an position value based on the at least one co-operating recording position and the apparatus position; and apply the position value to the at least one audio component position, such that the at least one audio component position is substantially aligned with the apparatus position.

Determining the position value may cause the apparatus to: determine a magnitude of the difference between the at least one audio component position and the at least one co-operating apparatus recording position is greater than a position threshold value; and generate the position value as the angle of at least one co-operating apparatus recording position relative to an apparatus observing position.

The apparatus may be further caused to: receive the at least one audio signal from a first of the at least one co-operating apparatus; receive at least one video signal from a second of the at least one co-operating apparatus; wherein determining an position value may cause the apparatus to: determine the first co-operating apparatus and the second co-operating apparatus are physically separate; determine a magnitude of the difference between the at least one audio component position and the first co-operating apparatus recording position is greater than a position threshold value; and generate the position value as the angle of the first co-operating apparatus recording position relative to a second co-operating apparatus video capture position.

Applying at least one associated orientation for the at least one audio component dependent on the position value may cause the apparatus to generate a compensated position value for the at least one audio component by adding the position value to the at least one position.

The at least one audio signal may comprise at least one co-operating apparatus recording position data stream associated with the at least one audio signal data and the apparatus caused to analyse the at least one audio signal may be further caused to separate the co-operating apparatus recording position data from the at least one audio signal data.

The apparatus may be further caused to select the first co-operating apparatus and the second co-operating apparatus from a plurality of co-operating apparatus.

The apparatus may be further caused to receive the at least one co-operating apparatus recording position.

According to a second aspect there is provided an apparatus comprising at least one processor and at least one memory including computer code for one or more programs, the at least one memory and the computer code configured to with the at least one processor cause the apparatus to at least: provide at least one audio signal; analyse the at least one audio signal to determine at least one audio component position relative to an apparatus recording position; and transmit the at least one audio component position relative to the apparatus recording position to a further apparatus caused to determine an position value based on the apparatus recording position and the further apparatus position; and apply the position value to the at least one audio component position, such that the at least one audio component position is substantially aligned with the further apparatus position.

Providing the at least one audio signal may cause the apparatus to provide the audio signal from a microphone array and wherein analysing the at least one audio signal to determine at least one audio component with an position relative to the apparatus recording position may cause the apparatus to determine an orientation value based on the recording position and a position of the microphone array.

According to a third aspect there is provided an apparatus comprising at least one processor and at least one memory including computer code for one or more programs, the at least one memory and the computer code configured to with the at least one processor cause the apparatus to at least: receive from a first co-operating apparatus at least one audio signal; receive from a second co-operating apparatus a second recording position; analyse at least one audio signal to determine at least one audio component position relative to a first co-operating apparatus recording position; determine an position value based on the second co-operating apparatus recording position and the at least one audio component position; and apply the position value to the at least one audio component position, such that the at least one audio component position is substantially aligned with the second co-operating apparatus recording position.

Determining the position value may cause the apparatus to: determine the magnitude of the difference between the at least one audio component position and the first co-operating apparatus recording position is greater than a position threshold value; and generate the position value as the angle of the first co-operating apparatus recording position relative to the second co-operating apparatus recording position.

The apparatus may further be caused to: receive the at least one audio signal from the first co-operating apparatus; receive at least one video signal from the second co-operating apparatus; wherein determining an position value may cause the apparatus to: determine the first co-operating apparatus and the second co-operating apparatus are physically separate; determine the magnitude of the difference between the at least one audio component position and the first co-operating apparatus recording position is greater than an position threshold value; generate the position value as the angle of the first co-operating apparatus recording position relative to a second co-operating apparatus recording position, wherein the second co-operating apparatus recording position is a second co-operating apparatus video capture position.

The apparatus may be further caused to output the processed audio signal to the listening apparatus.

Analysing the at least one audio signal to determine at least one audio component with an associated position may cause the apparatus to: identify at least two separate audio channels; generate at least one audio signal frame comprising a selection of audio signal samples from the at least two separate audio channels; time-to-frequency domain convert the at least one audio signal frame to generate a frequency domain representation of the at least one audio signal frame for the at least two separate audio channels; filter the frequency domain representation into at least two sub-band frequency domain representation for the at least two separate audio channels; compare at least two sub-band frequency domain representation for the at least two separate audio channels to determine an audio component in common; and determine the position of the audio component based on the comparison.

According to a fourth aspect there is provided a method comprising: receiving at an apparatus from at least one further apparatus at least one audio signal; analysing the at least one audio signal to determine at least one audio component position relative to the at least one further apparatus recording position; determine an position value based on the at least one further apparatus recording position and the apparatus position; and applying the position value to the at least one audio component position, such that the at least one audio component position is substantially aligned with the apparatus position.

Determining the position value may comprise: determining a magnitude of the difference between the at least one audio component position and the at least one further apparatus recording position is greater than a position threshold value; and generating the position value as the angle of at least one further apparatus recording position relative to an apparatus observing position.

The method may comprise: receiving the at least one audio signal from a first of the at least one further apparatus; receiving at least one video signal from a second of the at least one further apparatus; wherein determining an position value may comprise: determining the first further apparatus and the second further apparatus are physically separate: determining a magnitude of the difference between the at least one audio component position and the first further apparatus recording position is greater than a position threshold value; and generating the position value as the angle of the first further apparatus recording position relative to a second further apparatus video capture position.

Applying at least one associated orientation for the at least one audio component dependent on the position value may comprise generating a compensated position value for the at least one audio component by adding the position value to the at least one position.

The at least one audio signal may comprise at least one further apparatus recording position data stream associated with the at least one audio signal data and analysing the at least one audio signal may comprise separating the further apparatus recording position data from the at least one audio signal data.

The method may comprise selecting the first further apparatus and the second further apparatus from a plurality of further apparatus.

The method may comprise receiving the at least one further apparatus recording position.

According to a fifth aspect there is provided a method comprising: providing at least one audio signal; analysing the at least one audio signal to determine at least one audio component position relative to an apparatus recording position; and transmitting the at least one audio component position relative to the apparatus recording position to a further apparatus configured to determine an position value based on the apparatus recording position and the further apparatus position; and apply the position value to the at least one audio component position, such that the at least one audio component position is substantially aligned with the further apparatus position.

Providing the at least one audio signal may comprise providing the audio signal from a microphone array and wherein analysing the at least one audio signal to determine at least one audio component with an position relative to the apparatus recording position may comprise determining an orientation value based on the recording position and a position of the microphone array.

According to a sixth aspect there is provided a method comprising: receiving from a first co-operating apparatus at least one audio signal; receiving from a second co-operating apparatus a second recording position; analysing at least one audio signal to determine at least one audio component position relative to a first co-operating apparatus recording position; determining an position value based on the second co-operating apparatus recording position and the at least one audio component position; and applying the position value to the at least one audio component position, such that the at least one audio component position is substantially aligned with the second co-operating apparatus recording position.

Determining the position value may comprise: determining the magnitude of the difference between the at least one audio component position and the first co-operating apparatus recording position is greater than a position threshold value; and generating the position value as the angle of the first co-operating apparatus recording position relative to the second co-operating apparatus recording position.

The method may further comprise; receiving the at least one audio signal from the first co-operating apparatus; receiving at least one video signal from the second co-operating apparatus; wherein determining an position value may comprise: determining the first co-operating apparatus and the second co-operating apparatus are physically separate; determining the magnitude of the difference between the at least one audio component position and the first co-operating apparatus recording position is greater than an position threshold value; generating the position value as the angle of the first co-operating apparatus recording position relative to a second co-operating apparatus recording position, wherein the second co-operating apparatus recording position is a second co-operating apparatus video capture position.

The method may further comprise outputting the processed audio signal to the listening apparatus.

Analysing the at least one audio signal to determine at least one audio component with an associated position may comprise: identifying at least two separate audio channels; generating at least one audio signal frame comprising a selection of audio signal samples from the at least two separate audio channels; time-to-frequency domain converting the at least one audio signal frame to generate a frequency domain representation of the at least one audio signal frame for the at least two separate audio channels; filtering the frequency domain representation into at least two sub-band frequency domain representation for the at least two separate audio channels; comparing at least two sub-band frequency domain representation for the at least two separate audio channels to determine an audio component in common; and determining the position of the audio component based on the comparison.

According to a seventh aspect there is provided an apparatus comprising: means for receiving from at least one further apparatus at least one audio signal; means for analysing the at least one audio signal to determine at least one audio component position relative to the at least one further apparatus recording position; means for determine an position value based on the at least one further apparatus recording position and the apparatus position; and means for applying the position value to the at least one audio component position, such that the at least one audio component position is substantially aligned with the apparatus position.

The means for determining the position value may comprise: means for determining a magnitude of the difference between the at least one audio component position and the at least one further apparatus recording position is greater than a position threshold value; and means for generating the position value as the angle of at least one further apparatus recording position relative to an apparatus observing position.

The apparatus may comprise: means for receiving the at least one audio signal from a first of the at least one further apparatus; receiving at least one video signal from a second of the at least one further apparatus; wherein the means for determining an position value may comprise: means for determining the first further apparatus and the second further apparatus are physically separate; means for determining a magnitude of the difference between the at least one audio component position and the first further apparatus recording position is greater than a position threshold value; and means for generating the position value as the angle of the first further apparatus recording position relative to a second further apparatus video capture position.

The means for applying at least one associated orientation for the at least one audio component dependent on the position value may comprise means for generating a compensated position value for the at least one audio component by adding the position value to the at least one position.

The at least one audio signal may comprise at least one further apparatus recording position data stream associated with the at least one audio signal data and means for analysing the at least one audio signal may comprise means for separating the further apparatus recording position data from the at least one audio signal data.

The apparatus may comprise means for selecting the first further apparatus and the second further apparatus from a plurality of further apparatus.

The apparatus may comprise means for receiving the at least one further apparatus recording position.

According to an eighth aspect there is provided an apparatus comprising: means for providing at least one audio signal; means for analysing the at least one audio signal to determine at least one audio component position relative to an apparatus recording position; and means for transmitting the at least one audio component position relative to the apparatus recording position to a further apparatus configured to determine an position value based on the apparatus recording position and the further apparatus position; and apply the position value to the at least one audio component position, such that the at least one audio component position substantially aligned with the further apparatus position.

The means for providing the at least one audio signal may comprise means for providing the audio signal from a microphone array and wherein the means for analysing the at least one audio signal to determine at least one audio component with an position relative to the apparatus recording position may comprise means for determining a position value based on the recording position and a position of the microphone array.

According to a ninth aspect there is provided an apparatus comprising: means for receiving from a first co-operating apparatus at least one audio signal; means for receiving from a second co-operating apparatus a second recording position; means for analysing at least one audio signal to determine at least one audio component position relative to a first co-operating apparatus recording position; means for determining an position value based on the second co-operating apparatus recording position and the at least one audio component position; and means for applying the position value to the at least one audio component position, such that the at least one audio component position is substantially aligned with the second co-operating apparatus recording position.

The means for determining the position value may comprise: means for determining the magnitude of the difference between the at least one audio component position and the first co-operating apparatus recording position is greater than a position threshold value; and means for generating the position value as the angle of the first co-operating apparatus recording position relative to the second co-operating apparatus recording position.

The apparatus may further comprise: means for receiving the at least one audio signal from the first co-operating apparatus; means for receiving at least one video signal from the second co-operating apparatus; wherein the means for determining an position value may comprise: means for determining the first co-operating apparatus and the second co-operating apparatus are physically separate; means for determining the magnitude of the difference between the at least one audio component position and the first co-operating apparatus recording position is greater than an position threshold value; means for generating the position value as the angle of the first co-operating apparatus recording position relative to a second co-operating apparatus recording position, wherein the second co-operating apparatus recording position is a second co-operating apparatus video capture position.

The apparatus may further comprise means for outputting the processed audio signal to the listening apparatus.

The means for analysing the at least one audio signal to determine at least one audio component with an associated position may comprise: means for identifying at least two separate audio channels; means for generating at least one audio signal frame comprising a selection of audio signal samples from the at least two separate audio channels; means for time-to-frequency domain converting the at least one audio signal frame to generate a frequency domain representation of the at least one audio signal frame for the at least two separate audio channels; means for filtering the frequency domain representation into at least two sub-band frequency domain representation for the at least two separate audio channels; means for comparing at least two sub-band frequency domain representation for the at least two separate audio channels to determine an audio component in common; and means for determining the position of the audio component based on the comparison.

According to an tenth aspect there is provided an apparatus comprising: an input configured to receive from at least one co-operating apparatus at least one audio signal; an audio signal analyser configured to analyse the at least one audio signal to determine at least one audio component position relative to the at least one co-operating apparatus recording position; a processor configured to determine an position value based on the at least one co-operating recording position and the apparatus position, and further configured to apply the position value to the at least one audio component position, such that the at least one audio component position is substantially aligned with the apparatus position.

The processor may comprise: a difference threshold determiner configured to determine a magnitude of the difference between the at least one audio component position and the at least one co-operating apparatus recording position is greater than a position threshold value; and a difference shift determiner configured to generate the position value as the angle of at least one co-operating apparatus recording position relative to an apparatus observing position.

The input may comprise: a first input configured to receive the at least one audio signal from a first of the at least one co-operating apparatus; a second input configured to receive at least one video signal from a second of the at least one co-operating apparatus; wherein the processor may comprise: a discriminator configured to determine the first co-operating apparatus and the second co-operating apparatus are physically separate; a difference threshold determiner configured to determine a magnitude of the difference between the at least one audio component position and the first co-operating apparatus recording position is greater than a position threshold value; and a difference shift determiner configured to generate the position value as the angle of the first co-operating apparatus recording position relative to a second co-operating apparatus video capture position.

The processor may comprise a position compensator configured to generate a compensated position value for the at least one audio component by adding the position value to the at least one position.

The at least one audio signal may comprise at least one co-operating apparatus recording position data stream associated with the at least one audio signal data and the audio signal analyser may comprise a separator configured to separate the co-operating apparatus recording position data from the at least one audio signal data.

The apparatus may comprise a selector configured to select the first co-operating apparatus and the second co-operating apparatus from a plurality of co-operating apparatus.

The apparatus may comprise a position input configured to receive the at least one co-operating apparatus recording position.

According to an eleventh aspect there is provided an apparatus comprising: a signal generator configured to provide at least one audio signal; an audio signal analyser configured to analyse the at least one audio signal to determine at least one audio component position relative to an apparatus recording position; and a transmitter configured to transmit the at least one audio component position relative to the apparatus recording position to a further apparatus caused to determine an position value based on the apparatus recording position and the further apparatus position; and apply the position value to the at least one audio component position, such that the at least one audio component position is substantially aligned with the further apparatus position.

The signal generator may comprise a microphone array and wherein the audio signal analyser may be configured to determine a position value based on the recording position and a position of the microphone array.

According to a twelfth aspect there is provided an apparatus comprising: an input configured to receive from a first co-operating apparatus at least one audio signal; a second input configured to receive from a second co-operating apparatus a second recording position; an audio signal analyser configured to analyse at least one audio signal to determine at least one audio component position relative to a first co-operating apparatus recording position; a processor configured to determine an position value based on the second co-operating apparatus recording position and the at least one audio component position, and further configured to apply the position value to the at least one audio component position, such that the at least one audio component position is substantially aligned with the second co-operating apparatus recording position.

The processor may comprise: a threshold difference determiner configured to determine the magnitude of the difference between the at least one audio component position and the first co-operating apparatus recording position is greater than a position threshold value; and a difference shift determiner configured to generate the position value as the angle of the first co-operating apparatus recording position relative to the second co-operating apparatus recording position.

The apparatus may further comprise a first input configured to receive the at least one audio signal from the first co-operating apparatus; a second input configured to receive at least one video signal from the second co-operating apparatus; wherein the processor may comprise: a discriminator configured to determine the first co-operating apparatus and the second co-operating apparatus are physically separate; a difference threshold determiner configured to determine the magnitude of the difference between the at least one audio component position and the first co-operating apparatus recording position is greater than an position threshold value; and a difference shift determiner configured to generate the position value as the angle of the first co-operating apparatus recording position relative to a second co-operating apparatus recording position, wherein the second co-operating apparatus recording position is a second co-operating apparatus video capture position.

The apparatus may further comprise an output configured to output the processed audio signal to the listening apparatus.

The audio signal analyser may comprise: a signal channel identifier configured to identify at least two separate audio channels; a frame segmenter configured to generate at least one audio signal frame comprising a selection of audio signal samples from the at least two separate audio channels; a time-to-frequency domain converter configured to time-to-frequency domain convert the at least one audio signal frame to generate a frequency domain representation of the at least one audio signal frame for the at least two separate audio channels; a filter configured to filter the frequency domain representation into at least two sub-band frequency domain representation for the at least two separate audio channels; a comparator configured to compare at least two sub-band frequency domain representation for the at least two separate audio channels to determine an audio component in common; and a position determiner configured to determine the position of the audio component based on the comparison.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For better understanding of the present application, reference will now be made by way of example to the accompanying drawings in which.

EMBODIMENTS

The following describes in further detail suitable apparatus and possible mechanisms for the provision of effective orientation or direction compensation for audio capture and audio listening apparatus within audio-video capture apparatus. In the following examples audio signals and processing is described. However it would be appreciated that in some embodiments the audio signal/audio capture and processing is a part of an audio system.

As described above spatial audio and video capture or recording when performed simultaneously by several devices or apparatus from multiple recording directions produces audio recording which cannot be directly mixed together because the audio sources are 'located' in different directions when experience by the apparatus performing the compilation or mixing. Similarly audio recorded by one apparatus or device cannot be used with the video from another device easily where the two devices are at different angles to the object of interest. In both of the examples described above where a spatial audio (and video recording) is captured of an object from multiple directions the audio cannot be played back independently of the direction from which the recording was made without producing an unnatural experience.

This effect is because video of a scene is typically recorded from the 'front' or 'rear' or the apparatus. When the video and audio signals are provided to the viewer (facing the direction of the scene) then the displayed image is 'aligned' with scene. Similarly sound sources which are recorded in front are also 'aligned' with the scene.

Figure 9:
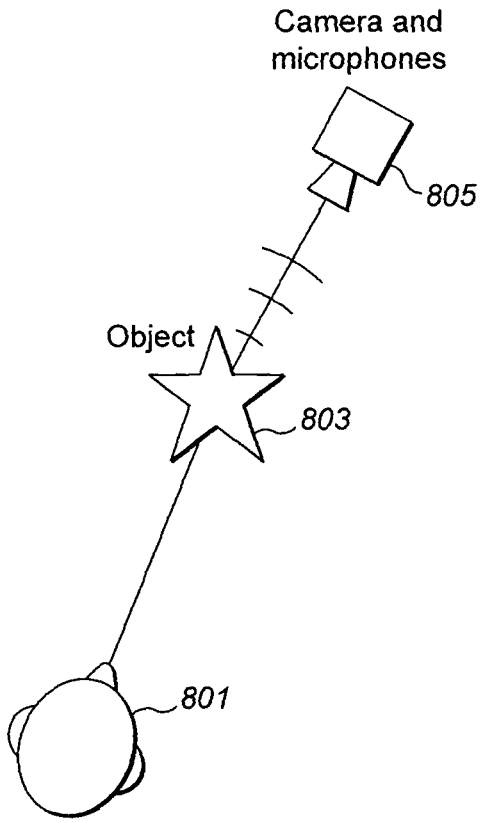
FIG. 9 shows an example situation of a modelled object being the dominant sound source.

This effect can be shown with respect to FIG. 9. FIG. 9 shows an example audio or audio-video scene, which is recorded and then viewed. In the example scene an object 803 or object of interest is captured by a capture apparatus or device 805 comprising a camera and microphones directed at the object 803 and configured to capture both audio signals and video signals from the object 803. Furthermore as shown in FIG. 9, a viewing apparatus (shown by the viewer 801) is directed towards the scene object 803 but at a different position than the capture apparatus 805. The viewing apparatus 801 position would not necessarily cause a problem as when the audio-video signals are viewed by the user of the viewing apparatus 801 the audio captured by the capture apparatus is substantially in line with the camera and so when the audio and video are played back the user of the viewing apparatus will see the image and hear the audio substantially in line.

However sound sources in other directions appear to be rotated relative to the visual element producing the sound source (the actual rotation occurs between the recording direction and the viewing direction). Thus audio sources which are at the edge of the visual screen appear to come from a different direction from the direction on screen when viewed.

This effect would also be experienced for sound sources located at the sides and behind the apparatus (user) where switching from different recording devices would cause the experienced audio source to change places.

For example two musicians on a stage, a first positioned on the right of the stage and the other to the left of the stage could be captured or recorded by two devices. Where the two devices are located such that both the musicians are located directly in front of the devices then switching between the two would not create sound source dislocation in a third party. However where one device records from the front of the stage and the other from behind the stage then switching between audio capture signals would cause sound source dislocation. The switching between audio capture signals can be implemented for example where the device or apparatus behind the stage has a better audio signal but the device or apparatus in front of the stage has the best video. However by combining the video from the front of the stage and the audio from the rear of the stage the musicians will appear swapped between video and audio signals. In other words the musician seen on the right of the video image will sound as if they are producing sound on the left and vice versa.

In other words a problem can occur where a 'background' sound source with respect to the capture apparatus is the dominant sound source.

Figure 7:
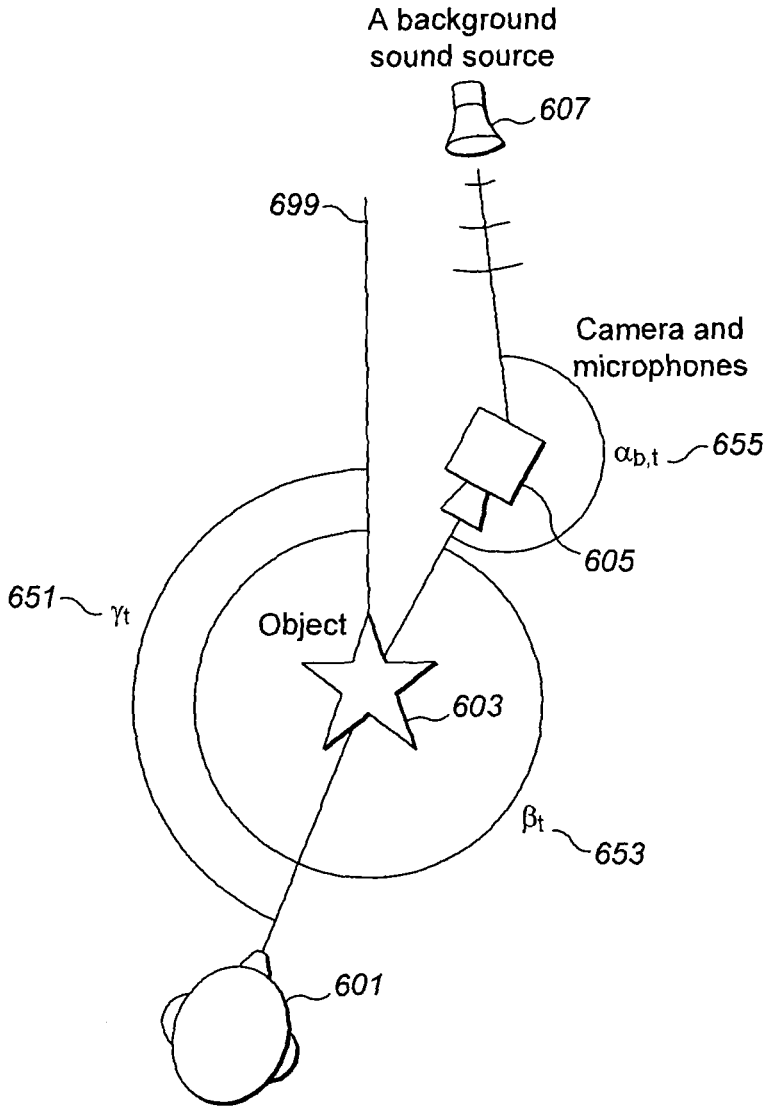
FIG. 7 shows an example situation of a background sound being the dominant sound source.

This effect is shown with respect to FIG. 7 where an example an example audio or audio-video scene, which is recorded and then viewed. The example scene is similar to that shown in FIG. 9 in that there is an object 803 or object of interest being captured by a capture apparatus or device 805 comprising a camera and microphones directed at the object 803 and configured to capture both audio signals and video signals from the object 803. Furthermore the viewing apparatus (shown by the viewer 801) is directed towards the scene object 803 but at a different position than the capture apparatus 805. The difference between the example shown in FIG. 9 and in FIG. 7 is that a background sound source 607 is a dominant sound source with respect capture apparatus 605 microphones.

In the example shown in FIG. 7 the angle between the background sound source 607 and the object 603 as experienced by the capture apparatus 605 can be defined as angle $\alpha$ 655. Furthermore the angle between a datum orientation 699 (which in some embodiments can be 'North' or any suitable orientation datum) and the capture apparatus 605 as experienced by the object 603 is defined by an angle $\beta$ 653, and the angle between the datum orientation 699 and the viewing apparatus 601 as experienced by the object 603 is defined by an angle $\gamma$ 651.

Figure 8:
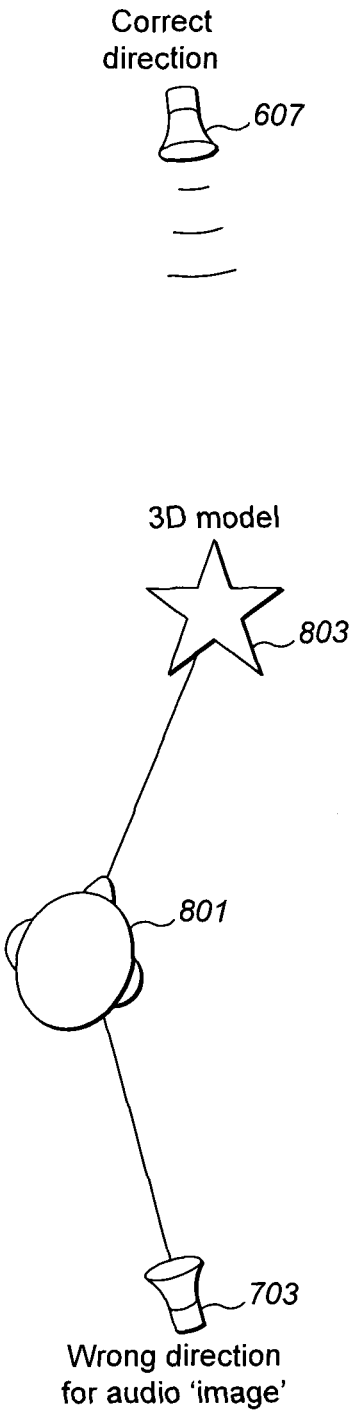
FIG. 8 shows an example situation of a background sound being the dominant sound source when experienced in playback.

FIG. 8 shows the effect of the background sound source 607 when viewed/listened by the viewing apparatus 801. When viewed by the viewing apparatus 801 the object 803 is in line but the dominant sound source 607 is reproduced by the viewing apparatus 801 as a 'ghost' sound source 703 which is not where the viewing apparatus 801 expects the dominant sound source 607 to be.

The concept as described herein by embodiments of the application is to determine audio signal or sound sources outside of the main object of interest or region of view with respect to the video capture and process these audio signals (for example rotate them spatially), such that they can be reproduced with corrected directionality. In such embodiments audio signals from capture apparatus in different directions can be mixed together or used independently of the recording direction. In the following examples an orientation determination for the audio sources within the recorded audio signal and furthermore orientation alignment using orientation shifts are discussed such that the audio sources orientations are aligned with the apparatus generating the listening output or with a suitable video recording orientation. However it would be understood that in some embodiments positional determination of the audio sources, the recording apparatus (audio recording and/or video recording) and any suitable positional alignment using determined position values can be performed as a generalisation of the orientation determination and alignment apparatus and methods described herein. In other words the apparatus can analyse the at least one audio signal to determine at least one audio component position relative to the at least one co-operating apparatus recording position. The apparatus can further determine an position value based on the at least one co-operating recording position and the apparatus position and apply the position value to the at least one audio component position, such that the at least one audio component position is substantially aligned with the apparatus position.

Therefore in some embodiments from the viewpoint of the signal processor the apparatus can comprise: an input configured to receive from at least one co-operating apparatus at least one audio signal; an audio signal analyser configured to analyse the at least one audio signal to determine at least one audio component position relative to the at least one co-operating apparatus recording position; and a processor configured to determine an position value based on the at least one co-operating recording position and the apparatus position, and further configured to apply the position value to the at least one audio component position, such that the at least one audio component position is substantially aligned with the apparatus position.

From the viewpoint of the signal generator apparatus the apparatus can in some embodiments comprise: a signal generator configured to provide at least one audio signal; an audio signal analyser configured to analyse the at least one audio signal to determine at least one audio component position relative to an apparatus recording position; and a transmitter configured to transmit the at least one audio component position relative to the apparatus recording position to a further apparatus caused to determine an position value based on the apparatus recording position and the further apparatus position; and apply the position value to the at least one audio component position, such that the at least one audio component position is substantially aligned with the further apparatus position.

Furthermore from an audio server viewpoint the apparatus can comprise: an input configured to receive from a first co-operating apparatus at least one audio signal; a second input configured to receive from a second co-operating apparatus a second recording position; an audio signal analyser configured to analyse at least one audio signal to determine at least one audio component position relative to a first co-operating apparatus recording position; and a processor configured to determine an position value based on the second co-operating apparatus recording position and the at least one audio component position, and further configured to apply the position value to the at least one audio component position, such that the at least one audio component position is substantially aligned with the second co-operating apparatus recording position.

Figure 1:
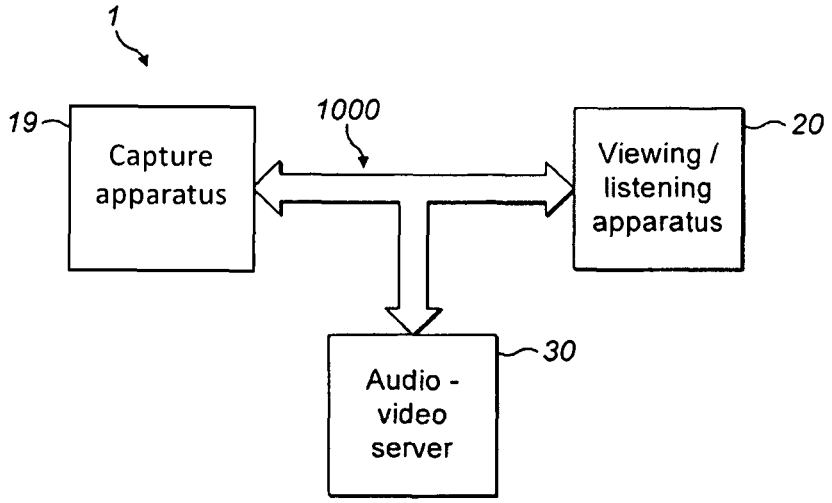
FIG. 1 shows schematically an audio capture and listening system which may encompass embodiments of the application.

With respect to FIG. 1 an overview of a suitable system within which embodiments of the application can be located is shown.

The audio scene 1 can have located within it at least one recording or capture device or apparatus 19 positioned within the audio scene to record suitable audio and video scenes. The capture apparatus 19 can be configured to capture the audio and/or video scene or activity within the audio scene. The activity can be any event the user of the capture apparatus 19 wishes to capture. For example the event can be a music event or a news worthy event. The capture apparatus 19 can in some embodiments transmit or alternatively store for later consumption the captured audio and/or video signals. The capture apparatus 19 can transmit over a transmission channel 1000 to a viewing/listening apparatus 20 or in some embodiments to an audio server 30. The capture apparatus 19 in some embodiments can encode the audio and/or video signal to compress the audio/video signal in a known way in order to reduce the bandwidth required in "uploading" the audio/video signal to the audio-video server 30 or viewing/listening apparatus 20.

The capture apparatus 19 in some embodiments can be configured to upload or transmit via the transmission channel 1000 to the audio-video server 30 or viewing/listening apparatus 20 an estimation of the position/location and/or the orientation (or direction) of the apparatus. The positional information can be obtained, for example, using GPS coordinates, cell-id or assisted GPS or only other suitable location estimation methods and the orientation/position/direction can be obtained, for example using a digital compass, accelerometer, or GPS information.

In some embodiments the capture apparatus 19 can be configured to capture or record one or more audio signals. For example the apparatus in some embodiments can comprise multiple sets of microphones, each microphone set configured to capture the audio signal from a different direction. In such embodiments the capture apparatus 19 can record and provide more than one signal from the different position/direction/orientations and further supply position/orientation information for each signal.

In some embodiments the system comprises a viewing/listening apparatus 20. The viewing/listening apparatus 20 can be coupled directly to the capture apparatus 19 via the transmission channel 1000. In some embodiments the audio and/or video signal and other information can be received from the capture apparatus 19 via the audio-video server 30. In some embodiments the viewing/listening apparatus 20 can prior to or during downloading an audio signal select a specific recording apparatus or a defined listening point which is associated with a recording apparatus or group of recording apparatus. In other words in some embodiments the viewing/listening apparatus 20 can be configured to select a position from which to 'listen' to the recorded or captured audio scene. In such embodiments the viewing/listening apparatus 20 can select a capture apparatus 19 or enquire from the audio-video server 30 the suitable recording apparatus audio and/or video stream associated with the selected listening point or position.

The viewing/listening apparatus 20 is configured to receive a suitably encoded audio signal, decode the video/audio signal and present the video/audio signal to the user operating the viewing/listening apparatus 20.

In some embodiments the system comprises an audio-video server 30. The audio-video server in some embodiments can be configured to receive audio/video signals from the capture apparatus 19 and store the audio/video signals for later recall by the viewing/listening apparatus 20. The audio-video server 30 can be configured in some embodiments to store multiple recording apparatus audio/video signals. In such embodiments the audio-video server 30 can be configured to receive an indication from a viewing/listening apparatus 20 indicating one of the audio/video signals or in some embodiments a mix of at least two audio/video signals from different recording apparatus.

Figure 2:
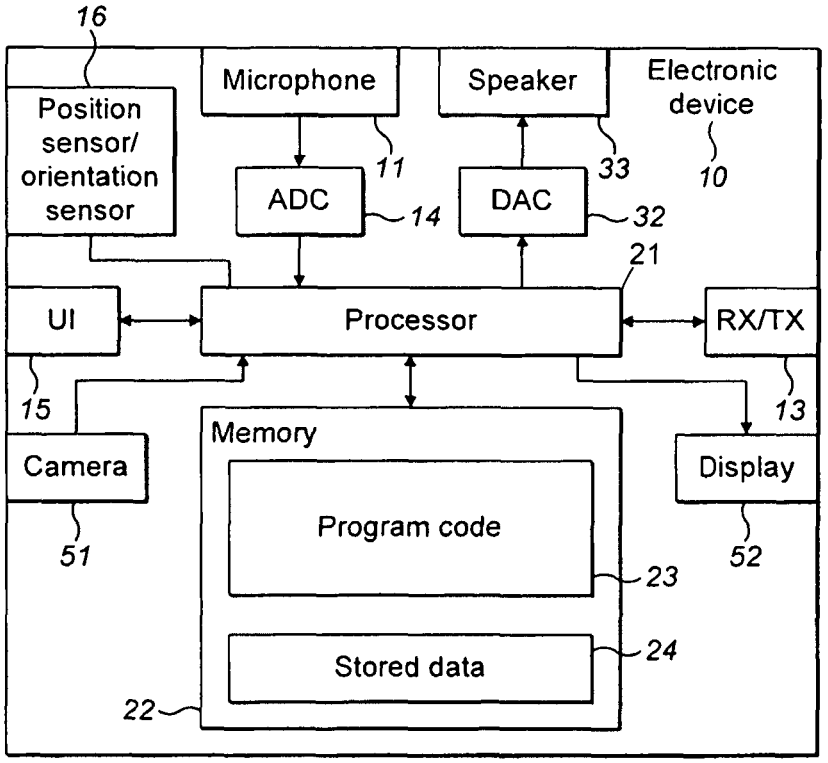
FIG. 2 shows schematically an apparatus suitable for being employed in some embodiments.

In this regard reference is first made to FIG. 2 which shows a schematic block diagram of an exemplary apparatus or electronic device 10, which may be used to record (or operate as a capture apparatus 19) or view/listen (or operate as a viewing/listening apparatus 20) to the audio signals (and similarly to record or view the audio-visual images and data). Furthermore in some embodiments the apparatus or electronic device can function as the audio-video server 30. It would be understood that in some embodiments the same apparatus can be configured or re-configured to operate as all of the capture apparatus 19, viewing/listening apparatus 20 and audio-video server 30.

The electronic device 10 may for example be a mobile terminal or user equipment of a wireless communication system when functioning as the recording apparatus or listening apparatus. In some embodiments the apparatus can be an audio player or audio recorder, such as an MP3 player, a media recorder/player (also known as an MP4 player), or any suitable portable apparatus suitable for recording audio or audio/video camcorder/memory audio or video recorder.

The apparatus 10 can in some embodiments comprise an audio-video subsystem. The audio-video subsystem for example can comprise in some embodiments a microphone or array of microphones 11 for audio signal capture. In some embodiments the microphone or array of microphones can be a solid state microphone, in other words capable of capturing audio signals and outputting a suitable digital format signal. In some other embodiments the microphone or array of microphones 11 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or micro electrical-mechanical system (MEMS) microphone. In some embodiments the microphone 11 is a digital microphone array, in other words configured to generate a digital signal output (and thus not requiring an analogue-to-digital converter). The microphone 11 or array of microphones can in some embodiments output the audio captured signal to an analogue-to-digital converter (ADC) 14.

In some embodiments the apparatus can further comprise an analogue-to-digital converter (ADC) 14 configured to receive the analogue captured audio signal from the microphones and outputting the audio captured signal in a suitable digital form. The analogue-to-digital converter 14 can be any suitable analogue-to-digital conversion or processing means. In some embodiments the microphones are 'integrated' microphones containing both audio signal generating and analogue-to-digital conversion capability.

In some embodiments the apparatus 10 audio-vide subsystem further comprises a digital-to-analogue converter 32 for converting digital audio signals from a processor 21 to a suitable analogue format. The digital-to-analogue converter (DAC) or signal processing means 32 can in some embodiments be any suitable DAC technology.

Furthermore the audio-video subsystem can comprise in some embodiments a speaker 33. The speaker 33 can in some embodiments receive the output from the digital-to-analogue converter 32 and present the analogue audio signal to the user.

In some embodiments the speaker 33 can be representative of multi-speaker arrangement, a headset, for example a set of headphones, or cordless headphones.

In some embodiments the apparatus audio-video subsystem comprises a camera 51 or image capturing means configured to supply to the processor 21 image data. In some embodiments the camera can be configured to supply multiple images over time to provide a video stream.

In some embodiments the apparatus audio-video subsystem comprises a display 52. The display or image display means can be configured to output visual images which can be viewed by the user of the apparatus. In some embodiments the display can be a touch screen display suitable for supplying input data to the apparatus. the display can be any suitable display technology, for example the display can be implemented by a flat panel comprising cells of LCD, LED, OLED, or 'plasma' display implementations.

Although the apparatus 10 is shown having both audio/video capture and audio/video presentation components, it would be understood that in some embodiments the apparatus 10 can comprise one or the other of the audio capture and audio presentation parts of the audio subsystem such that in some embodiments of the apparatus the microphone (for audio capture) or the speaker (for audio presentation) are present. Similarly in some embodiments the apparatus 10 can comprise one or the other of the video capture and video presentation parts of the video subsystem such that in some embodiments the camera 51 (for video capture) or the display 52 (for video presentation) is present.

In some embodiments the apparatus 10 comprises a processor 21. The processor 21 is coupled to the audio-video subsystem and specifically in some examples the analogue-to-digital converter 14 for receiving digital signals representing audio signals from the microphone 11, the digital-to-analogue converter (DAC) 12 configured to output processed digital audio signals, the camera 51 for receiving digital signals representing video signals, and the display 52 configured to output processed digital video signals from the processor 21.

The processor 21 can be configured to execute various program codes. The implemented program codes can comprise for example audio-video recording and audio-video presentation routines. In some embodiments the program codes can be configured to perform audio signal modelling or spatial audio signal processing.

In some embodiments the apparatus further comprises a memory 22. In some embodiments the processor is coupled to memory 22. The memory can be any suitable storage means. In some embodiments the memory 22 comprises a program code section 23 for storing program codes implementable upon the processor 21. Furthermore in some embodiments the memory 22 can further comprise a stored data section 24 for storing data, for example data that has been encoded in accordance with the application or data to be encoded via the application embodiments as described later. The implemented program code stored within the program code section 23, and the data stored within the stored data section 24 can be retrieved by the processor 21 whenever needed via the memory-processor coupling.

In some further embodiments the apparatus 10 can comprise a user interface 15. The user interface 15 can be coupled in some embodiments to the processor 21. In some embodiments the processor can control the operation of the user interface and receive inputs from the user interface 15. In some embodiments the user interface 15 can enable a user to input commands to the electronic device or apparatus 10, for example via a keypad, and/or to obtain information from the apparatus 10, for example via a display which is part of the user interface 15. The user interface 15 can in some embodiments as described herein comprise a touch screen or touch interface capable of both enabling information to be entered to the apparatus 10 and further displaying information to the user of the apparatus 10.

In some embodiments the apparatus further comprises a transceiver 13, the transceiver in such embodiments can be coupled to the processor and configured to enable a communication with other apparatus or electronic devices, for example via a wireless communications network. The transceiver 13 or any suitable transceiver or transmitter and/or receiver means can in some embodiments be configured to communicate with other electronic devices or apparatus via a wire or wired coupling.

The coupling can, as shown in FIG. 1, be the transmission channel 1000. The transceiver 13 can communicate with further apparatus by any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the apparatus comprises a position sensor 16 configured to estimate the position of the apparatus 10. The position sensor 16 can in some embodiments be a satellite positioning sensor such as a GPS (Global Positioning System), GLONASS or Galileo receiver.

In some embodiments the positioning sensor can be a cellular ID system or an assisted GPS system.

In some embodiments the apparatus 10 further comprises a direction or orientation sensor. The orientation/direction sensor can in some embodiments be an electronic compass, accelerometer, and a gyroscope or be determined by the motion of the apparatus using the positioning estimate.

It is to be understood again that the structure of the electronic device 10 could be supplemented and varied in many ways.

Furthermore it could be understood that the above apparatus 10 in some embodiments can be operated as an audio-video server 30. In some further embodiments the audio-video server 30 can comprise a processor, memory and transceiver combination.

In the following embodiments the elements described herein can be located throughout the audio-video system. In other words it would be understood that parts of the following example can be implemented in the capture apparatus 19, some parts implemented within the viewing apparatus 20 and some parts implemented within an audio-video server 30.

Figure 3:
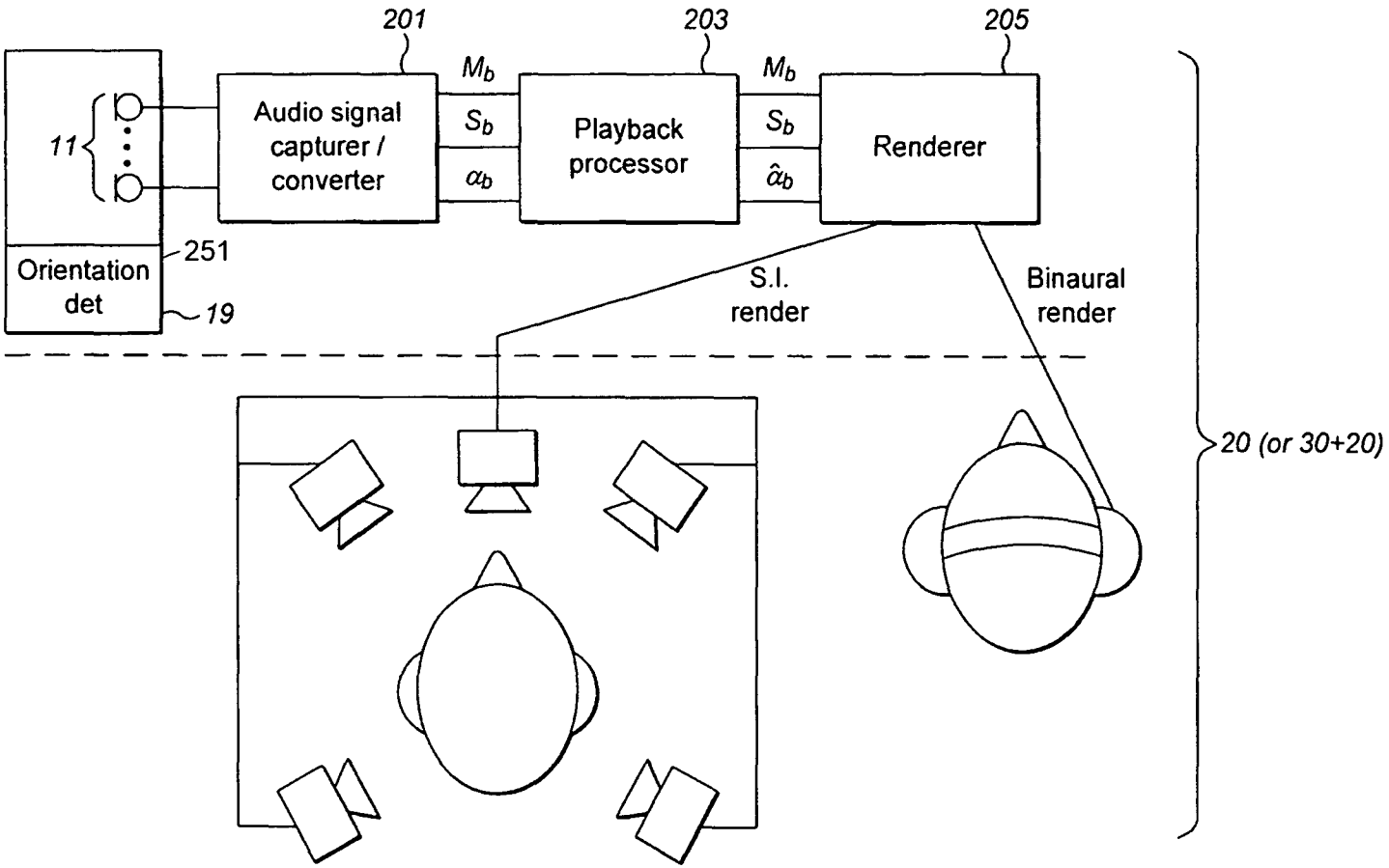
FIG. 3 shows schematically an example spatial audio signal processing apparatus according to some embodiments.

With respect to FIG. 3 an example audio processing system according to some embodiments is shown.

In some embodiments the capture apparatus 19 (for example apparatus comprising the camera and microphone such as shown by the capture apparatus 806 shown in FIGS. 7 to 9) comprises a microphone array 11, such as described herein with respect to FIG. 2, configured to generate audio signals from the acoustic waves in the neighbourhood of the capture apparatus. It would be understood that in some embodiments the microphone array 11 is not physically coupled or attached to the recording apparatus (for example the microphones can be attached to a headband or headset worn by the user of the recording apparatus) and can transmit the audio signals to the recording apparatus. For example the microphones mounted on a headset or similar apparatus are coupled by a wired or wireless coupling to the recording apparatus. The capture apparatus 19 is represented in FIG. 3 by the microphone(s) 11.

Figure 4:
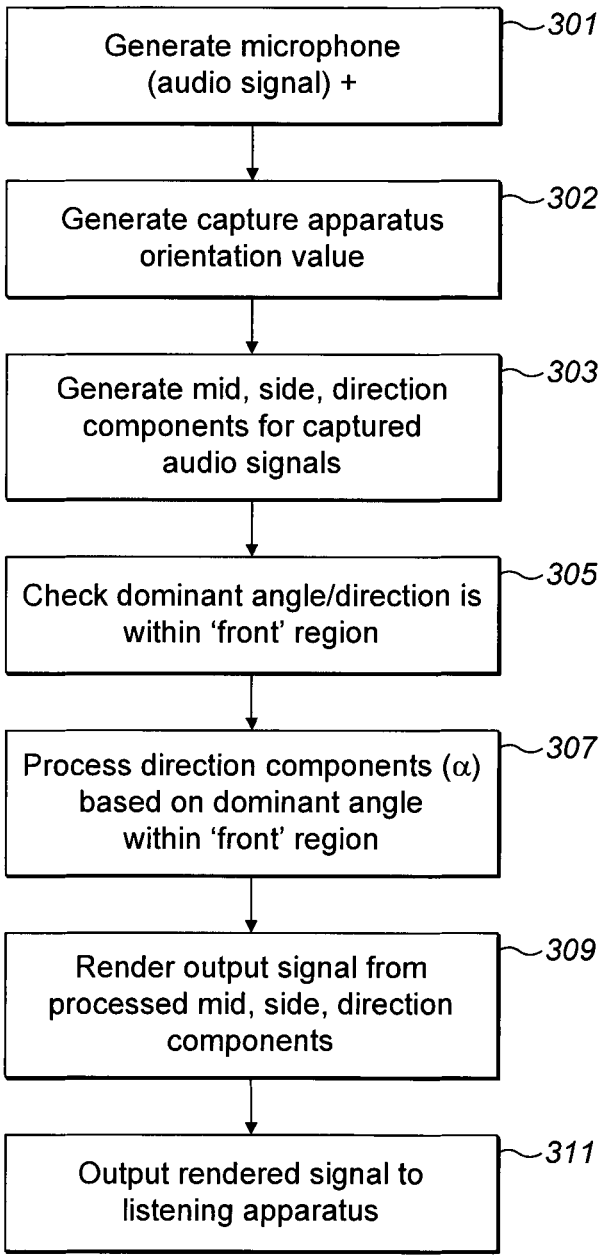
FIG. 4 shows schematically a flow diagram of the spatial audio signal processing apparatus shown in FIG. 3 according to some embodiments.

The operation of generating at least one audio signal from the at least one microphone is shown in FIG. 4 by step 301.

The capture apparatus 19 in some embodiments comprises a position determiner or an orientation determiner 251 configured to receive or determine the capture apparatus (and in particular the microphone(s)) position/orientation. It would be understood that in some embodiments, for example where the microphones are not physically coupled to the capture apparatus (for example mounted on a head set separate from the capture apparatus) that the position sensor, orientation sensor or determination can be located on the microphones, for example with a sensor in the headset and this information is transmitted or passed to the audio-video server 30 or the viewing/listening apparatus 20.

The capture apparatus position and/or orientation information can in some embodiments be sampled or provided at a lower frequency rate than the audio signals are sampled.

For example in some embodiments a positional or an orientation sampling frequency of 100 Hz provides acceptable results. The positional or orientation information can be generated according to any suitable format. For example in some embodiments the orientation information can be in the form of an orientation parameter. The orientation parameter can be represented in some embodiments by a floating point number or fixed point (or integer) value. Furthermore in some embodiments the resolution of the orientation information can be any suitable resolution. For example, as it is known that the resolution of human auditory system in its best region (in front of the listener) is about ~1 degree the orientation information (azimuth) value can be an integer value from 0 to 360 with a resolution of 1 degree. However it would be understood that in some embodiments a resolution of greater than or less than 1 degree can be implemented especially where signalling efficiency or bandwidth is limited.

The operation of generating positional/orientation values for the capture apparatus is shown in FIG. 4 by step 302.

In some embodiments the audio-video server 30 or the viewing/listening apparatus 20 comprises an audio signal capturer/converter 201. The audio signal capturer/converter 201 can be configured to receive the audio signals and the orientation information. From the audio signals the audio signal capturer/converter 201 can be configured to generate a suitable parameterised audio signal for further processing.

For example in some embodiments the audio signal capturer/converter 201 can be configured to generate mid, side, and direction components for the captured audio signals across various sub bands.

An example spatial parameterisation of the audio signal is described as follows. However it would be understood that any suitable audio signal spatial or directional parameterisation in either the time or other representational domain (frequency domain etc.) can be used.

In some embodiments the audio signal capturer/converter 201 comprises a framer. The framer or suitable framer means can be configured to receive the audio signals from the microphones and divide the digital format signals into frames or groups of audio sample data. In some embodiments the framer can furthermore be configured to window the data using any suitable windowing function. The framer can be configured to generate frames of audio signal data for each microphone input wherein the length of each frame and a degree of overlap of each frame can be any suitable value. For example in some embodiments each audio frame is 20 milliseconds long and has an overlap of 10 milliseconds between frames. The framer can be configured to output the frame audio data to a Time-to-Frequency Domain Transformer.

In some embodiments the audio signal capturer/converter 201 comprises a Time-to-Frequency Domain Transformer. The Time-to-Frequency Domain Transformer or suitable transformer means can be configured to perform any suitable time-to-frequency domain transformation on the frame audio data. In some embodiments the Time-to-Frequency Domain Transformer can be a Discrete Fourier Transformer (DFT). However the Transformer can be any suitable Transformer such as a Discrete Cosine Transformer (DCT), a Modified Discrete Cosine Transformer (MDCT), a Fast Fourier Transformer (FFT) or a quadrature mirror filter (QMF). The Time-to-Frequency Domain Transformer can be configured to output a frequency domain signal for each microphone input to a sub-band filter.

In some embodiments the audio signal capturer/converter 201 comprises a sub-band filter. The sub-band filter or suitable means can be configured to receive the frequency domain signals from the Time-to-Frequency Domain Transformer for each microphone and divide each microphone audio signal frequency domain signal into a number of sub-bands.

The sub-band division can be any suitable sub-band division. For example in some embodiments the sub-band filter can be configured to operate using psychoacoustic filtering bands. The sub-band filter can then be configured to output each domain range sub-band to a direction analyser.

In some embodiments the audio signal capturer/converter 201 can comprise a direction analyser. The direction analyser or suitable means can in some embodiments be configured to select a sub-band and the associated frequency domain signals for each microphone of the sub-band.

The direction analyser can then be configured to perform directional analysis on the signals in the sub-band. The directional analyser can be configured in some embodiments to perform a cross correlation between the microphone/decoder sub-band frequency domain signals within a suitable processing means.

In the direction analyser the delay value of the cross correlation is found which maximises the cross correlation of the frequency domain sub-band signals. This delay can in some embodiments be used to estimate the angle or represent the angle from the dominant audio signal source for the sub-band. This angle can be defined as $\alpha$. It would be understood that whilst a pair or two microphones can provide a first angle, an improved directional estimate can be produced by using more than two microphones and preferably in some embodiments more than two microphones on two or more axes.

The directional analyser can then be configured to determine whether or not all of the sub-bands have been selected. Where all of the sub-bands have been selected in some embodiments then the direction analyser can be configured to output the directional analysis results. Where not all of the sub-bands have been selected then the operation can be passed back to selecting a further sub-band processing step.

The above describes a direction analyser performing an analysis using frequency domain correlation values. However it would be understood that the direction analyser can perform directional analysis using any suitable method. For example in some embodiments the object detector and separator can be configured to output specific azimuth-elevation values rather than maximum correlation delay values. Furthermore in some embodiments the spatial analysis can be performed in the time domain.

In some embodiments this direction analysis can therefore be defined as receiving the audio sub-band data;

$$X_k^b(n)=X_k(n_b+n),\ n=0,\ldots,n_{b+1}-n_b-1,\ b=0,\ldots,B-1$$

where $n_b$ is the first index of bth subband. In some embodiments for every subband the directional analysis as described herein as follows. First the direction is estimated with two channels. The direction analyser finds delay $\tau_b$ that maximizes the correlation between the two channels for subband b. DFT domain representation of e.g. $X_k^b(n)$ can be shifted $\tau_b$ time domain samples using $$X_{k,T_b}^b(n) = X_k^b(n)e^{-j\frac{A\pi n\gamma_b}{N}}.$$

The optimal delay in some embodiments can be obtained from $$\max_{\tau_b} \mathrm{Re}\left(\sum_{n=b}^{n_{b+1}-n_b-1} \left(X_{2,\tau_b}^b(n) \cdot X_3^b(n)\right)\right), \tau_b \in [-D_{tot}, D_{tot}]$$

where Re indicates the real part of the result and * denotes complex conjugate. $x_{2,\tau_b}{}^b$ and $X_3{}^b$ are considered vectors with length of $n_{b+1}-n_b$ samples. The direction analyser can in some embodiments implement a resolution of one time domain sample for the search of the delay.

In some embodiments the direction analyser can be configured to generate a sum signal. The sum signal can be mathematically defined as.

$$X_{sum}^b = \begin{cases} \left(X_{2,\tau_b}^b + X_3^b\right)/2 & \tau_b \le 0 \\ \left(X_2^b + X_{3-\tau_b}^b\right)/2 & \tau_b > 0 \end{cases}$$

In other words the direction analyser is configured to generate a sum signal where the content of the channel in which an event occurs first is added with no modification, whereas the channel in which the event occurs later is shifted to obtain best match to the first channel.

It would be understood that the delay or shift $\tau_b$ indicates how much closer the sound source is to one microphone (or channel) than another microphone (or channel). The direction analyser can be configured to determine actual difference in distance as $$\Delta_{22} = \frac{v\tau_b}{F_2}$$

where Fs is the sampling rate of the signal and v is the speed of the signal in air (or in water if we are making underwater recordings).

The angle of the arriving sound is determined by the direction analyser as, $$d_b = \pm\cos^{-1}\left(\frac{\Delta_{23}^2 + 2b\Delta_{23} - d^2}{2db}\right)$$

where d is the distance between the pair of microphones/channel separation and b is the estimated distance between sound sources and nearest microphone. In some embodiments the direction analyser can be configured to set the value of b to a fixed value. For example b=2 meters has been found to provide stable results.

It would be understood that the determination described herein provides two alternatives for the direction of the arriving sound as the exact direction cannot be determined with only two microphones/channels.

In some embodiments the direction analyser can be configured to use audio signals from a third channel or the third microphone to define which of the signs in the determination is correct. The distances between the third channel or microphone and the two estimated sound sources are:

$$\delta_b^+ = \sqrt{(h + b\sin(\dot{\alpha}_b))^2 + (d/2 + b\cos(\dot{\alpha}_b))^2}$$

$$\delta_b^- = \sqrt{(h - b\sin(\dot{\alpha}_b))^2 + (d/2 + b\cos(\dot{\alpha}_b))^2}$$

where h is the height of an equilateral triangle (where the channels or microphones determine a triangle), i.e.

$$h = \frac{\sqrt{3}}{2}d.$$

The distances in the above determination can be considered to be equal to delays (in samples) of;

$$\tau_b^+ = \frac{\delta^+ - b}{v}F_s$$

$$\tau_b^- = \frac{\delta^- - b}{v}F_2$$

Out of these two delays the direction analyser in some embodiments is configured to select the one which provides better correlation with the sum signal. The correlations can for example be represented as $$c_b^+ = \mathrm{Re}\left(\sum_{n=0}^{n_{b+1}-n_b-1} \left(X_{sum,\tau_b^+}^b(n) \cdot X_1^b(n)\right)\right)$$

$$c_b^- = \mathrm{Re}\left(\sum_{n=0}^{n_{b+1}-n_b-1} \left(X_{sum,\tau_b^-}^b(n) \cdot X_1^b(n)\right)\right)$$

The direction analyser can then in some embodiments then determine the direction of the dominant sound source for subband b as:

$$\alpha_b = \begin{cases} \dot{\alpha}_b & c_b^+ \ge c_b^- \\ -\dot{\alpha}_b & c_b^+ < c_b^- \end{cases}.$$

In some embodiments the audio signal capturer/converter 201 comprises a mid/side signal generator. The main content in the mid signal is the dominant sound source found from the directional analysis. Similarly the side signal contains the other parts or ambient audio from the generated audio signals. In some embodiments the mid/side signal generator can determine the mid M and side S signals for the sub-band according to the following equations:

$$M^b = \begin{cases} \left(X_{2,\tau_b}^b + X_3^b\right)/2 & \tau_b \le 0 \\ \left(X_2^b + X_{3,-\tau_b}^b\right)/2 & \tau_b > 0 \end{cases}$$

$$S^b = \begin{cases} \left(X_{2,\tau_b}^b - X_2^b\right)/2 & \tau_b \le 0 \\ \left(X_2^b - X_{3-\tau_b}^b\right)/2 & \tau_b > 0 \end{cases}$$

It is noted that the mid signal M is the same signal that was already determined previously and in some embodiments the mid signal can be obtained as part of the direction analysis. The mid and side signals can be constructed in a perceptually safe manner such that the signal in which an event occurs first is not shifted in the delay alignment. The mid and side signals can be determined in such a manner in some embodiments is suitable where the microphones are relatively close to each other. Where the distance between the microphones is significant in relation to the distance to the sound source then the mid/side signal generator can be configured to perform a modified mid and side signal determination where the channel is always modified to provide a best match with the main channel.

The mid (M), side (S) and direction ($\alpha$) components of the captured audio signals can be output to a playback processor 203.

In some embodiments the audio signal(s) can be parameterised in the capture apparatus 19 and passed to the audio-video server 30 or the viewing/listening apparatus in a parameterised format. In other words in some embodiments the audio signal capturer/converter 201 can be implemented within the capture apparatus 19.

The operation of generating mid, side, direction components for the captured audio signals is shown in FIG. 4 by step 303.

In some embodiments the audio-video server 30 or the viewing/listening apparatus 20 comprises a playback processor 203. In some embodiments the playback processor 203 can be configured to receive the spatial parameterised audio signals (the mid, side and direction components) for the captured audio signals and check or determine whether the dominant sound source direction for a specific sub-band is from the front, from the side or from the rear of the capturing apparatus.

Therefore in some embodiments where the dominant sound source direction is from the front of the capture apparatus 19 then the direction component of the captured audio signal is not changed as it is assumed that the sound source is coming from the object being recorded or captured by the camera and therefore when viewing the audio is from the direction of the 'model'. However where the dominant sound or audio source is from a direction other than the front of the capture apparatus then the playback processor can be configured to perform a rotation of the direction parameters associated with the dominant audio or sound source such that the relative angle of the camera orientation and the viewer orientation relative to the 'object' being modelled is taken into account.

This can be implemented for example by determining a region defining a position and orientation 'front' of the recording or capture apparatus and using this as a threshold value where sound source parameters outside the region threshold are processed and the sound source parameters within the region threshold are not processed. In some embodiments the region can be defined from −30° to 30° relative to a forward direction of the capture apparatus. However it would be understood that the region can in some embodiments have a greater spread or angles or lesser spread of angles or have an offset.

The operation of checking the dominant sound direction is shown in FIG. 4 by step 305.

For example where $\alpha_{b,t}$=the direction of the dominant source for band b and time t, $\beta_t$=the direction from which the video was recorded at time t in other words the orientation of the capture apparatus determined by the orientation determiner 251, $\gamma_t$=the direction from which the object is viewed at time $\hat{t}$ in other words the orientation of the viewing/listening apparatus 20 and which can be determined in some embodiments by a compass of positional sensor within the viewing/listening apparatus 20. In the following examples t is the running time on the video when it is being recorded $\hat{t}$ is the running time when the object is being watched.

In some embodiments the playback processor 203 can be configured to perform the following processing to the angle $\alpha_{b,t}$ according to the following expression:

$$\hat{\alpha}_{b,t}\begin{cases} = \alpha_{b,t}, & -30^\circ \le \alpha_{bt} \le 30^\circ \\ = \alpha_{b,t} - \gamma_t + \beta_t, & \text{otherwise} \end{cases}$$

The playback processor 203 can then be configured to output the modified parameters to a renderer 205.

The operation of processing the position or orientation or direction components based on dominant audio source angle is shown in FIG. 4 by step 307.

In some embodiments the audio-video server 30 or the viewing/listening apparatus 20 comprises a renderer 205. The renderer 205 can be configured to receive the audio parameters and generate a rendering of the processed audio parameters in such a way that they can be output to the listener in a suitable manner. For example the processed audio parameters (mid, side and direction components) can be used to generate a suitable 5.1 channel audio render or a binaural channel render. However it would be understood that in some embodiments any suitable rendering of the parameters to generate an output signal can be performed.

The operation of rendering the output signal from the processed mid, side and direction components is shown in FIG. 4 by step 309.

The rendered audio signal can be passed to the listener or viewer to produce an improved experience as the viewing and listening experience would be aligned and there would in such embodiments be fewer 'ghost' or false audio sources.

The operation of outputting the rendered signal to the listening apparatus is shown in FIG. 4 by step 311.

In some embodiments the viewing/listening apparatus 30 can be configured to be capturing the video and therefore mix the received and processed audio signals with the video signals captured by the viewing/listening apparatus 30 to generate a whole audio-video signal.

Figure 5:
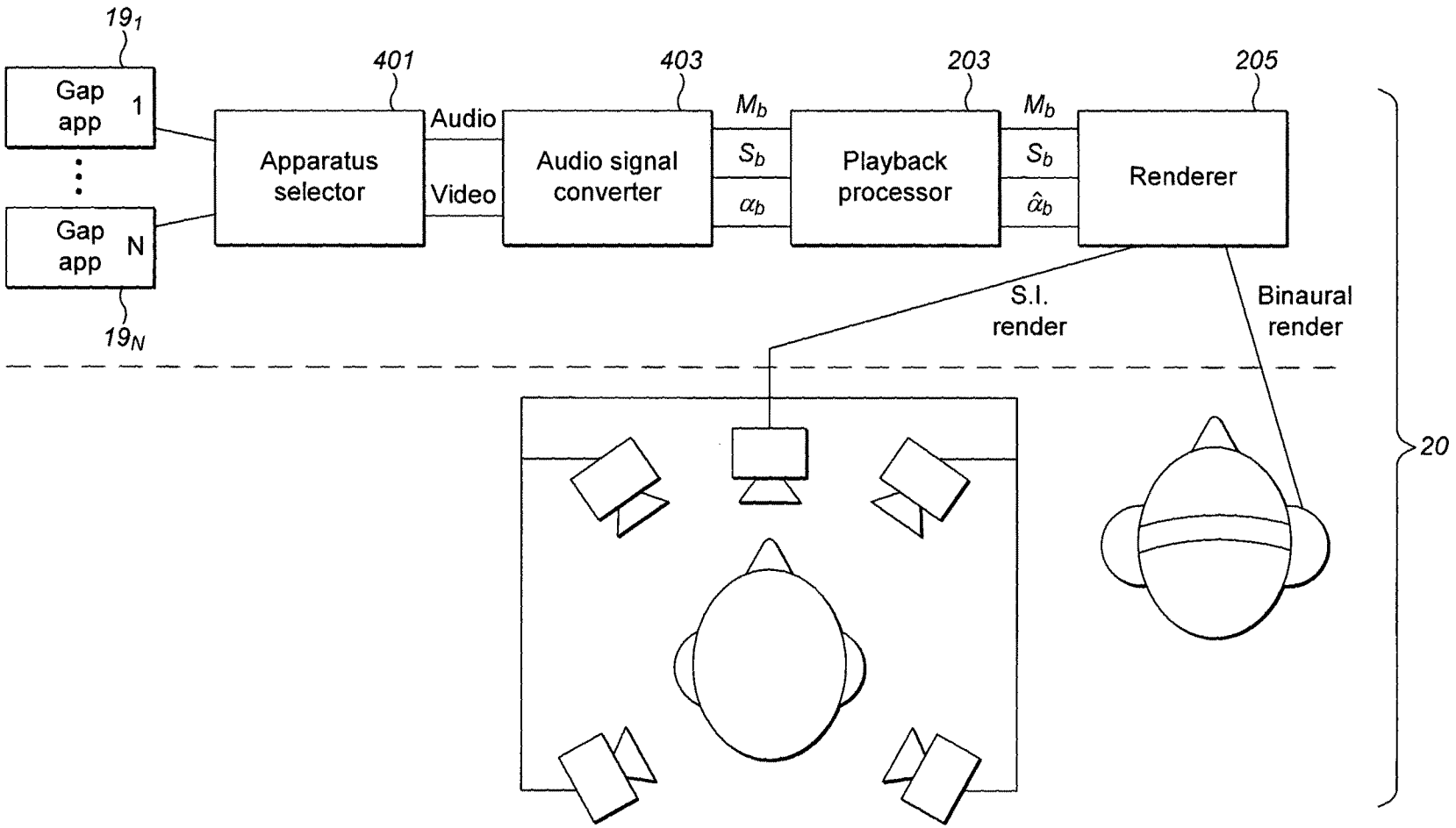
FIG. 5 shows schematically a further example spatial audio signal processing apparatus according to some embodiments

With respect to FIG. 5 a further example of a spatial audio processing system where there are multiple capture apparatus is shown. Furthermore with respect to FIG. 6 the operation of the system as shown in FIG. 5 is shown.

In the example implementation shown in FIG. 5 there is shown an audio processing system with more than one capture apparatus configured to capture audio/video signals. In the example shown in FIG. 5 there are N capture apparatus configured to be capturing the same scene but at different angles. The capture apparatus 19 are shown as capture apparatus 1, $\mathbf{19}_1$, to capture apparatus N, $\mathbf{19}_N$. Each of the capture apparatus can further comprise an orientation determiner such as shown in the capture apparatus 19 as described herein with respect to the example shown in FIG. 3. The capture apparatus 19 in some embodiments thus can be configured to output an audio signal, video signal, and orientation information to a device selector 401. It would be understood that in some embodiments capture apparatus can be configured to capture only one of audio or video of the scene.

Figure 6:
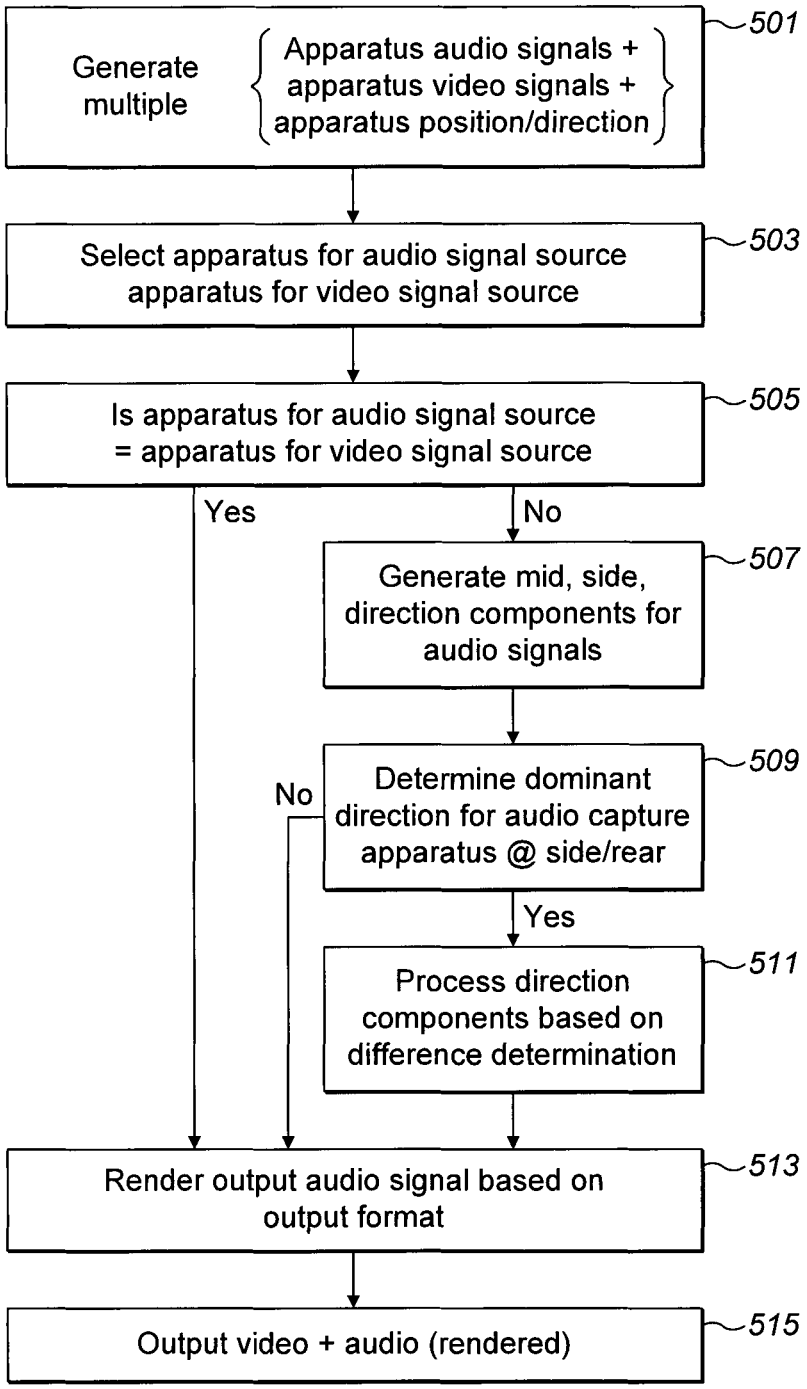
FIG. 6 shows schematically a flow diagram of the further spatial audio signal processing apparatus shown in FIG. 5 according to some embodiments.

The operation of generating multiple audio signals, video signals, and orientation information is shown in FIG. 6 by step 501.

In some embodiments the audio-video server 30 (where the audio-video is processed centrally) or the viewing/listening apparatus 20 (where the audio-video is processed locally before being presented to the user) comprises an apparatus selector 401. The apparatus selector can be configured to receive the capture apparatus audio signals, the capture apparatus video signals, and the capture apparatus position, direction, or orientation information.

The apparatus selector 401 can be configured to select at least one of the capture apparatus as an audio signal source and at least one of the capture apparatus for a video signal source. The selection can be performed using any suitable manner. The selection can be automatic, for example the audio capture apparatus selected is the audio capture apparatus with the best quality capture configuration and similarly the video capture apparatus selected is the video capture apparatus with the best quality capture configuration. In some embodiments the selection can be semi-automatic, for example the viewing/listening apparatus can be configured to display a 'map' of suitable audio capture apparatus and suitable video capture apparatus with acceptable quality audio and video signals as determined by the audio-video server 30 or by the viewing/listening apparatus 20 from which an audio capture apparatus and video capture apparatus selected as signal sources. In some embodiments the selection can be manual, for example the viewing/listening apparatus can be configured to display a 'map' of available audio capture apparatus and video capture apparatus from which the user selects audio capture apparatus and video capture apparatus as signal sources.

The selection of the capture apparatus for audio signal source and capture apparatus for video signal source is shown in FIG. 6 by step 503.

In some embodiments the apparatus selector 401 can be configured to pass the selected audio and video signals to an audio signal converter 403.

In some embodiments the audio-video server 30 or the viewing/listening apparatus 20 comprises an audio signal converter 403. The audio signal converter 403 can be configured to determine whether the audio signal source capture apparatus is the same as the video signal source capture apparatus. In other words do the selected audio and video sources come from the same recording or capture apparatus.

The operation of performing the capture apparatus signal source is shown in FIG. 6 by step 505.

Where the signal sources originate from the same capture apparatus then the signal can be passed directly to the renderer 205 to be rendered in a suitable format to be output to the user.

Where the audio signal converter 403 determines that the signal sources originate from differing recording or capture apparatus then the audio signal converter 403 can be configured to generate spatial parameterised versions of the audio signals. In some embodiments the spatial parameterised versions can be the mid, side and direction components for the audio signals as shown in the single capture apparatus example shown in FIG. 3.

The operation of generating the mid, side and direction components for the audio signals is shown in FIG. 6 by step 507.

In some embodiments the audio signal converter 403 can output the converted component or spatial parameterised versions of the audio signal to the playback processor 203.

The playback processor 203 can in some embodiments be configured to receive the spatial parameterised audio signals (the mid, side and direction components) for the captured audio signals and check or determine whether the dominant sound source direction for a specific sub-band is from the front, from the side or from the rear of the audio source capturing apparatus.

Where the dominant sound source direction is from the front of the audio source capture apparatus 19 then the direction component of the captured audio signal is not changed as it is assumed that the sound source is coming from the object also being recorded or captured by the camera in the video stream capture apparatus and therefore when viewing both the video streams and the audio streams the audio is from the direction of the 'model'. However where the dominant sound or audio source is from a direction other than the front of the audio source capture apparatus then the playback processor 203 can be configured to perform a rotation of the direction parameters associated with the dominant audio or sound source such that the relative angle of the audio source capture apparatus orientation and the video source capture apparatus orientation relative to the 'object' being modelled is taken into account.

This can be implemented for example by determining a region defining a 'front' of the audio source capture apparatus and using this as a threshold value where sound source parameters outside the region threshold are processed and the sound source parameters within the region threshold are not processed. In some embodiments the region can be defined from −30° to 30° relative to a forward direction of the audio source capture apparatus. However it would be understood that the region can in some embodiments have a greater spread or angles or lesser spread of angles or have an offset.

The operation of determining the dominant direction for the audio capture apparatus is greater than a threshold value indicating the dominant audio source is at the side or rear of the audio capture apparatus is shown in FIG. 6 by step 509.

Mathematically this could be defined as $\alpha_{b,t}$=the direction of the dominant source in audio for band b and time t, $\beta_t$=the direction from which the audio was recorded at time t, $\gamma_t$=the direction from which the video was recorded at time t and t is the running time on the video when it is being recorded.

Then the playback processor 203 can be configured to perform the following processing to the angle $\alpha_{b,t}$ according to the following expression.

$$\hat{\alpha}_{b,t}\begin{cases} = \alpha_{b,t}, & -30^\circ \le a_{b,t} \le 30^\circ \\ = \alpha_{b,t} - \gamma_t + \beta_t, & \text{otherwise} \end{cases}$$

The operation of processing the direction components is shown in FIG. 6 by step 511.

The playback processor 203 can then pass the modified or processed audio signal to the renderer 205 to be rendered in a suitable format for the viewing/listening apparatus 20.

The operation of rendering the output audio signal based on the output format is shown in FIG. 6 by step 513.

In some embodiments the audio-video server 30 or the viewing/listening apparatus 20 comprises a renderer 205. The renderer 205 can be configured to receive the audio parameters and generate a rendering of the processed audio parameters in such a way that they can be output to the listener in a suitable manner. For example the processed audio parameters (mid, side and direction components) can be used to generate a suitable 5.1 channel audio render or a binaural channel render.

However it would be understood that in some embodiments any suitable rendering of the parameters to generate an output signal can be performed.

Furthermore the operation of outputting the video and audio which has been rendered is shown in FIG. 6 by step 515.

In such embodiments the video and audio rendered signals are effectively aligned independent of whether the source of the video and the audio signals is the same recording or capture apparatus. As such any of the video and audio sources can in some embodiments be mixed.

An example user interface/use case for the video recording case is where a user is recording a concert such as a rock concert using their audio-video capture apparatus, such as a mobile phone with camera and microphones. They notice that they are not in a good position for getting unobstructed video of the band and are quite far away from the speakers. However the capture apparatus also shows any locations of other capture apparatus in the locality also recording the concert and the directions and locations of the other capture apparatus. The user of the capture apparatus can then select a video stream or video signal from one of the other capture apparatus and an audio stream or audio signal from the same or a further capture apparatus.

Furthermore the capture apparatus operating as a viewing/listening apparatus can then mix or combine the audio signals from many different capture apparatus recording the concert to produce a better sound recording. The audio signals from the capture apparatus can then be rotated to match the video signals from the video capture apparatus according to the embodiments described herein.

In some embodiments the first user operating the capture apparatus in the poor location can define an object of interest through the display, and the system, such as the audio-video server 30, selects a 'best' video signal and audio signal from the capture apparatus recording the object of interest.

In some embodiments the object of interest is not the centre of the video while it is taken. The audio can be fixed by defining the audio region with an offset, in other words adding to the region defining the 'front' of the capture apparatus the difference between the image centre and object location before any of the calculations above.

In some embodiments the audio recording can be mono-channel, in other words is not necessarily multichannel.

In some embodiments the sound sources can be recognised 'in terms of position' from the video signal and can be separated from the audio track. Following this separation of the object any different sound sources could be rotated as described herein above.

Figure 10:
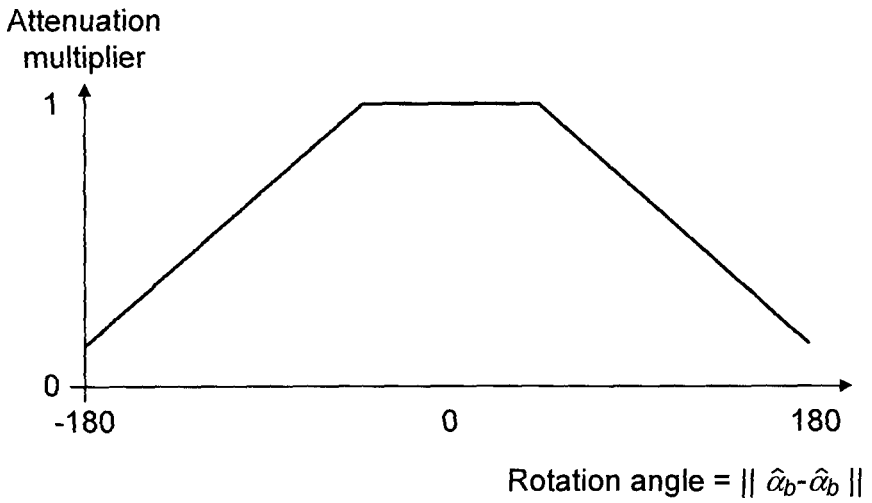
FIG. 10 shows an example attenuation profile to be applied to sound sources rotations according to some embodiments.

In some embodiments objects that are located close to 180° (in other words substantially behind the capture apparatus) can be attenuated to reduce artefacts and make them sound further away. For example in some embodiments the sub-bands M are attenuated by multiplying the bands $M_b$ by multiplying them with a multiplier as a function of $\|\hat{\alpha}_b-\hat{\alpha}_b\|$ as shown in FIG. 10.

In some embodiments a selection of a reference direction or an implicit reference direction is defined. An example reference direction could be for example magnetic north or some other angle dependent on magnetic north, a mobile platform such as a vehicle or a person, a structure defined by a GPS coordinate, another mobile device and differential tracking between the two, a variable reference such as a filtered direction of movement or any object in the virtual environment.

In some embodiments the use of GPS position and apparatus orientation signals it can be possible to map and store captured audio and clips to a virtual map. In such an embodiment when the user is using a map service and selects (or clicks) a stored clip on a map the audio can be played to the user from the view point the user has selected.

In some embodiments the microphone configuration can be omnidirectional to achieve high quality result in some other embodiments the microphones can be placed for example in front, back and side of the listeners head. Spatial audio capture (SPAC) format created by Nokia or directional audio coding (DirAC) are suitable methods for audio capture, directional analysis and processing and both enable orientation processing for the signals, SPAC requires that at least three microphones are available in the recording device to enable orientation processing.

In the embodiments described herein only orientation compensation are mentioned. However this can be extended to a full three dimensional compensation where pitch, roll, and yaw can be applied with specific microphone configurations or arrangements. In such embodiments selection of the reference direction can be agreed between the recording apparatus and listening apparatus (at least implicitly). In some embodiments the selected reference can be stored or transmitted as metadata with the audio signal.

In some embodiments the orientation processing can occur within the coding domain. However in some embodiments the audio signal can be processed within the non-coded domain.

It shall be appreciated that the term user equipment is intended to cover any suitable type of wireless user equipment, such as mobile telephones, portable data processing devices or portable web browsers, as well as wearable devices.

Furthermore elements of a public land mobile network (PLMN) may also comprise apparatus as described above.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one memory including computer code for one or more programs, the at least one memory and the computer code configured to with the at least one processor cause the apparatus to at least:

receive from at least one co-operating apparatus at least one audio signal;

analyse, with the at least one processor, the at least one audio signal to determine a position of at least one audio source relative to a recording position of the at least one co-operating apparatus;

determine a position value for the at least one audio source for sound reproduction from the apparatus based on the recording position of the at least one co-operating apparatus and a recording position of the apparatus; and based on the position value, processing the received at least one audio signal to modify the position of the at least one audio source, such that the position of the at least one audio source is aligned with the recording position of the apparatus in sound reproduction.

2. The apparatus as claimed in claim 1, wherein determining the position value causes the apparatus to determine a magnitude of the difference between the at least one audio source position and the at least one co-operating apparatus recording position is greater than a position threshold value.

3. The apparatus as claimed in claim 2, wherein determining the position value further causes the apparatus to generate the position value as an angle of at least one co-operating apparatus recording position relative to the apparatus position.

4. The apparatus as claimed in claim 1, further caused to:

receive the at least one audio signal from a first of the at least one co-operating apparatus;

receive at least one video signal from a second of the at least one co-operating apparatus; wherein determining a position value causes the apparatus to:

determine the first co-operating apparatus and the second co-operating apparatus are physically separate;

determine a magnitude of the difference between the at least one audio source position and a first co-operating apparatus recording position is greater than a position threshold value; and generate the position value as an angle of the first co-operating apparatus recording position relative to a second co-operating apparatus video capture position.

5. The apparatus as claimed in claim 1, wherein the based on the position value, processing the received at least one audio signal to modify the position of the at least one audio source, further causes the apparatus to generate a compensated position value for the at least one audio source by adding the position value.

6. The apparatus as claimed in claim 1, wherein the at least one audio signal comprises at least one co-operating apparatus recording position data stream associated with data of the at least one audio signal and the apparatus caused to analyse the at least one audio signal is further caused to separate the co-operating apparatus recording position data from the at least one audio signal data.

7. The apparatus as claimed in claim 4, further caused to select the first co-operating apparatus and the second co-operating apparatus from a plurality of co-operating apparatus.

8. The apparatus as claimed in claim 1, further caused to receive the at least one co-operating apparatus recording position.

9. An apparatus comprising at least one processor and at least one memory including computer code for one or more programs, the at least one memory and the computer code configured to with the at least one processor cause the apparatus to at least:

provide at least one audio signal;

analyse, with the at least one processor, the at least one audio signal to determine a position of at least one audio source relative to a recording position of the apparatus; and transmit the at least one audio source position relative to the apparatus recording position to a further apparatus caused to determine a position value based on the apparatus recording position and a further apparatus position; and based on the position value, processing the received at least one audio signal to modify the position of the at least one audio source, such that the position of the at least one audio source is aligned with the further apparatus position in sound reproduction.

10. The apparatus as claimed in claim 9, wherein providing the at least one audio signal causes the apparatus to provide the at least one audio signal from a microphone array and wherein analysing the at least one audio signal to determine at least one audio source with a position relative to the apparatus recording position causes the apparatus to determine an orientation value based on the apparatus recording position and a position of the microphone array.

11. An apparatus comprising at least one processor and at least one memory including computer code for one or more programs, the at least one memory and the computer code configured to with the at least one processor cause the apparatus to at least:

receive from a first co-operating apparatus at least one audio signal;

receive from a second co-operating apparatus a second co-operating apparatus recording position;

analyse, with the at least one processor, at least one audio signal to determine a position of at least one audio source relative to a recording position of the first co-operating apparatus;

determine a position value based on the second co-operating apparatus recording position and the at least one audio source position; and based on the position value, processing the received at least one audio signal to modify the position of the at least one audio source, such that the position of the at least one audio source is aligned with the recording position of the second co-operating apparatus in sound reproduction.

12. The apparatus as claimed in claim 11, wherein determining the position value causes the apparatus to determine the magnitude of the difference between the at least one audio source position and the first co-operating apparatus recording position is greater than a position threshold value.

13. The apparatus as claimed in claim 12, wherein determining the position value further causes the apparatus to generate the position value as the angle of the first co-operating apparatus recording position relative to the second co-operating apparatus recording position.

14. The apparatus as claimed in claim 11, further caused to:

receive the at least one audio signal from the first co-operating apparatus;

receive at least one video signal from the second co-operating apparatus; wherein determining a position value causes the apparatus to:

determine the first co-operating apparatus and the second co-operating apparatus are physically separate;

determine the magnitude of the difference between the at least one audio source position and the first co-operating apparatus recording position is greater than a position threshold value;

generate the position value as an angle of the first co-operating apparatus recording position relative to the second co-operating apparatus recording position, wherein the second co-operating apparatus recording position is a second co-operating apparatus video capture position.

15. The apparatus as claimed in claim 11, further caused to output the processed audio signal to a listening apparatus.

16. The apparatus as claimed in claim 1, wherein analysing the at least one audio signal to determine at least one audio component with an associated position causes the apparatus to:

identify at least two separate audio channels;

generate at least one audio signal frame comprising a selection of audio signal samples from the at least two separate audio channels; and time-to-frequency domain convert the at least one audio signal frame to generate a frequency domain representation of the at least one audio signal frame for the at least two separate audio channels.

17. The apparatus as claimed in claim 16, wherein analysing the at least one audio signal to determine at least one audio component with an associated position further causes the apparatus to:

filter the frequency domain representation into at least two sub-band frequency domain representations for the at least two separate audio channels;

compare the at least two sub-band frequency domain representations for the at least two separate audio channels to determine an audio component in common; and determine the position of the audio component in common based on the comparison.

18. The apparatus as claimed in claim 1, comprising:

an input configured to receive from the at least one co-operating apparatus the at least one audio signal;

an audio signal analyser configured to analyse the at least one audio signal to determine the at least one audio source position relative to the at least one co-operating apparatus recording position; and a processor configured to determine the position value based on the at least one co-operating recording position and the apparatus position, and further configured to apply the position value to the at least one audio source position, such that the at least one audio source position is aligned with the apparatus position.

19. The apparatus as claimed in claim 9, comprising:

a signal generator configured to provide the at least one audio signal;

an audio signal analyser configured to analyse the at least one audio signal to determine the at least one audio source position relative to the apparatus recording position; and a transmitter configured to transmit the at least one audio source position relative to the apparatus recording position to the further apparatus caused to determine the position value based on the apparatus recording position and the further apparatus position; and based on the position value, processing the received at least one audio signal to modify the position of the at least one audio source, such that the position of the at least one audio source is aligned with the further apparatus position in sound reproduction.

20. The apparatus as claimed in claim 11, comprising:

an input configured to receive from the first co-operating apparatus at least one audio signal;

a second input configured to receive from the second co-operating apparatus the second co-operating apparatus recording position;

an audio signal analyser configured to analyse the at least one audio signal to determine the at least one audio source position relative to the first co-operating apparatus recording position; and a processor configured to determine the position value based on the second co-operating apparatus recording position and the at least one audio source position, and based on the position value, processing the received at least one audio signal to modify the position of the at least one audio source, such that the position of the at least one audio source is aligned with the recording position of the second co-operating apparatus.

* * * * *